US008602211B2

(12) United States Patent
Sasur

(10) Patent No.: US 8,602,211 B2
(45) Date of Patent: Dec. 10, 2013

(54) NEEDLE HOLDER

(75) Inventor: David Sasur, Ludlow, MA (US)

(73) Assignee: Simplicity Pattern Co. Inc., Antioch, TN (US)

( * ) Notice: Subject to any disclaimer, the term of this patent is extended or adjusted under 35 U.S.C. 154(b) by 97 days.

(21) Appl. No.: 13/039,820

(22) Filed: Mar. 3, 2011

(65) Prior Publication Data

US 2012/0222978 A1 Sep. 6, 2012

(51) Int. Cl.
*B65D 85/28* (2006.01)

(52) U.S. Cl.
USPC ..... 206/380; 206/382; 206/480; 206/365; 206/341

(58) Field of Classification Search
USPC ..... 206/380, 382, 483, 477, 478, 480, 365
See application file for complete search history.

(56) References Cited

U.S. PATENT DOCUMENTS

| | | | | | |
|---|---|---|---|---|---|
| 599,561 | A * | 2/1898 | Hopewell | 112/221 |
| 3,133,683 | A * | 5/1964 | Deacon, Sr. | 225/62 |
| 3,761,976 | A * | 10/1973 | D'Amico | 206/216 |
| D265,863 | S * | 8/1982 | McCarn | D3/23 |
| 4,664,302 | A * | 5/1987 | Dalbo et al. | 223/109 R |
| 4,978,008 | A * | 12/1990 | Dalbo et al. | 206/574 |
| D334,249 | S * | 3/1993 | Whittaker | D28/66 |
| 5,437,362 | A * | 8/1995 | Sinn | 206/63.3 |
| 5,715,942 | A * | 2/1998 | Li et al. | 206/339 |
| 5,733,293 | A * | 3/1998 | Scirica et al. | 606/144 |
| 5,833,055 | A * | 11/1998 | Cerwin et al. | 206/63.3 |
| 5,845,774 | A * | 12/1998 | Hausknecht | 206/379 |
| 5,947,931 | A * | 9/1999 | Bierman | 604/180 |
| 6,997,334 | B2 * | 2/2006 | Manix et al. | 211/89.01 |
| 7,678,083 | B2 * | 3/2010 | Stephens | 604/174 |
| D625,966 | S * | 10/2010 | Maudsley | D7/636 |
| 2010/0170812 | A1 * | 7/2010 | Odierno | 206/63.3 |

* cited by examiner

*Primary Examiner* — J. Gregory Pickett
*Assistant Examiner* — Raven Collins
(74) *Attorney, Agent, or Firm* — Pillsbury Winthrop Shaw Pittman, LLP

(57) ABSTRACT

Disclosed is a holder for holding a set of knitting needles with a main body having first and second end portions. Each end portion has a corresponding aperture, and each aperture is sized to hold one knitting needle of the set of knitting needles. The holder can hold circular knitting needles connected by a flexible cord, for example. Slots may be provided to receive a portion of the flexible cord therein to reduce and/or prevent the cord from twisting and/or tangling during storage or transportation. The body may also have gauge for measuring a size of the knitting needles.

16 Claims, 9 Drawing Sheets

NEEDLE HOLDER

BACKGROUND

1. Field of Invention

The present invention is generally related to a portable holder for knitting needles.

2. Description of Related Art

Knitting needles (straight or circular) are typically stored and/or transported in a bag or case. When circular knitting needles with a flexible cord are stored, the cable and needles can become entangled.

SUMMARY

One aspect of this disclosure provides a holder for holding a set of knitting needles. The holder has a main body having first and second end portions. Each end portion has a corresponding aperture, and each aperture is sized to hold one knitting needle of the set of knitting needles.

In an embodiment, the set of knitting needles are circular knitting needles, each needle having a first end and a second end, the first ends being connected by a flexible cord. The corresponding apertures in the first and second end portions of the main body can be sized to hold the circular knitting needles therein. The holder can have one or more slots for receiving at least a portion of the flexible cord, which can assist in reducing and/or preventing twisting and/or tangling of the cord.

Other objects, features, and advantages of the present invention will become apparent from the following detailed description, the accompanying drawings, and the appended claims.

DETAILED DESCRIPTION OF THE PREFERRED EMBODIMENT(S)

Figure 1:
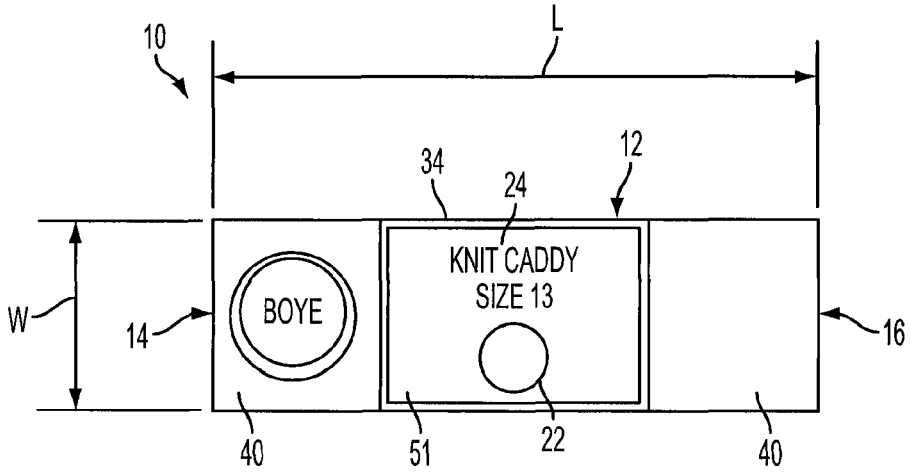
FIGS. 1-4 illustrate top views, a side view, and a perspective view, respectively, of a needle holder in accordance with an embodiment of the present invention.
Figure 2:
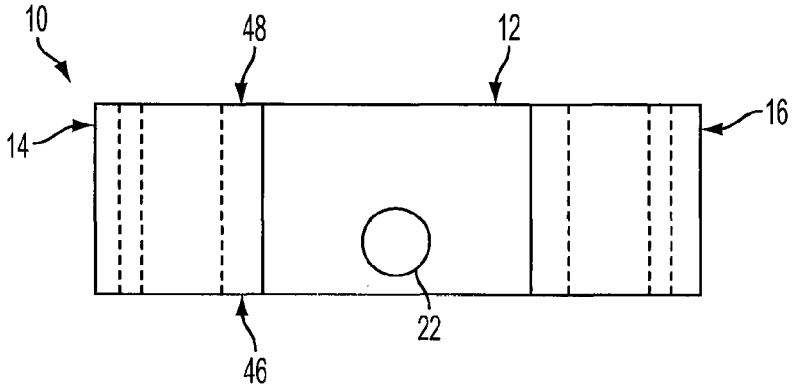

FIGS. 1-17 illustrate multiple exemplary embodiments of a portable holder 10 for holding a set of knitting needles. The portable holder 10 may be used alone or in combination with a caddy 32 (e.g., bag, pouch) (see FIG. 6) for storage and/or transportation of knitting needles. In the illustrated embodiment of FIGS. 5 and 6, a set of circular knitting needles 26 and 28 are shown in portable holder 10. As known in the art, each needle 26 and 28 of the set of circular knitting needles is substantially straight and has a first end and a second end. The first ends are connected by a flexible cord 30, while the second ends remain free (so that yarn can be worked and manipulated around the needles and cord). However, it should be understood that the illustrated embodiments in any of the FIGS. are not meant to be limited with regard to holding circular knitting needles. For example, any of the disclosed holders may also or alternatively hold one or more straight needles with free ends (i.e., without a cord attached thereto).

Referring to the embodiment of FIGS. 1-4, holder 10 comprises a main body 12 having a first end portion 14 and a second end portion 16 connected by a central portion 34. The central portion 34 and end portions 14, 16 form at least a top surface 40, a bottom surface 42, side surfaces 44, a front surface 46, and a back surface 48 of main body 12. Many of the components of FIGS. 5-12 are similar to those described with reference to FIGS. 1, 2, 3, and 4, and therefore, FIGS. 5-12 include similar or the same reference numbers.

Each end portion 14 and 16 has a corresponding aperture 18 and 20, respectively. In this illustrated embodiment, the apertures 18 and 20 comprise openings provided in side surfaces 44 and that extend between front surface 46 and back surface 48. Each aperture 18 and 20 is sized to receive and hold one knitting needle, each needle of which may be from of a set of knitting needles. For example, the corresponding apertures 18 and 20 in the end portions 14 and 16 may be sized to hold needles from circular knitting needles, i.e., knitting needle 26 may be inserted and held in aperture 18 and knitting needle 28 may be inserted and held in aperture 20 of the holder 10.

Figure 3:
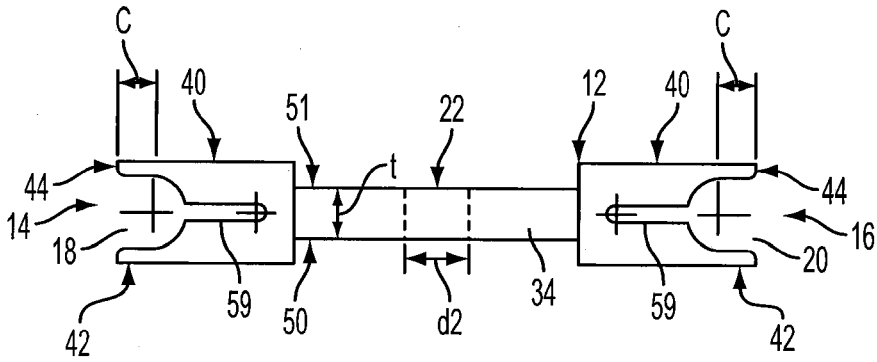
Figure 4:
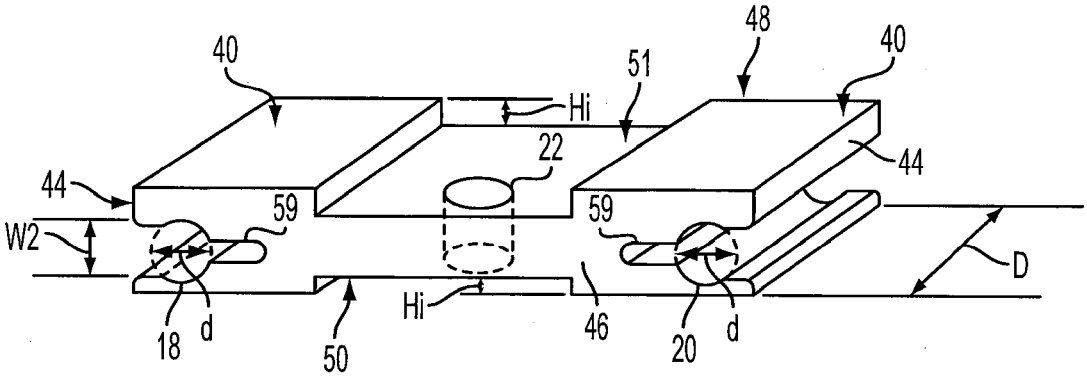
Figure 11:
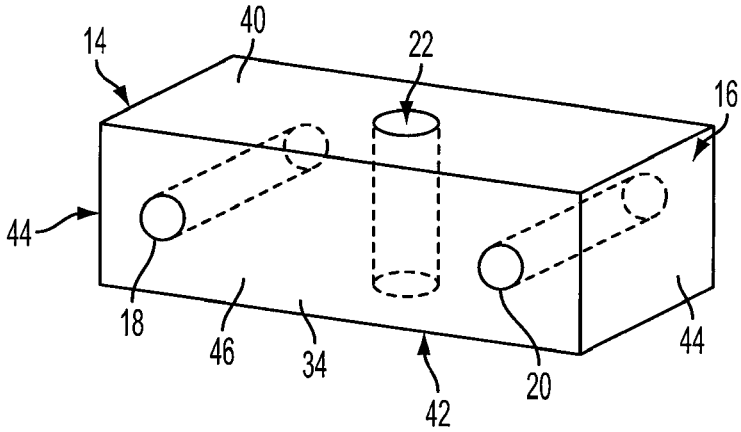
FIGS. 11 and 12 illustrate a perspective view and a side view, respectively, of a needle holder in accordance with yet another embodiment of the present invention.
Figure 12:
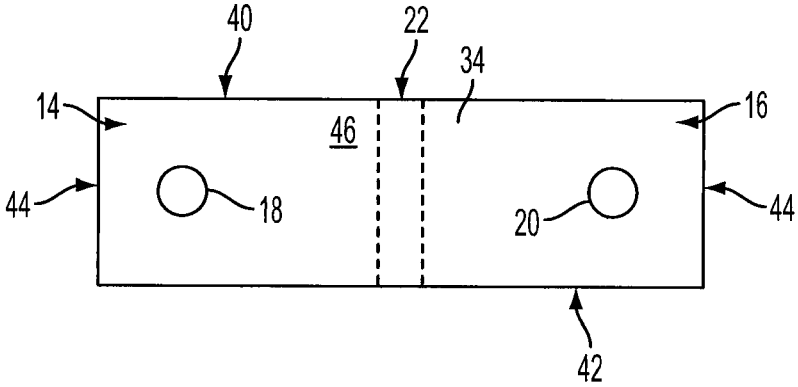
Figure 13:
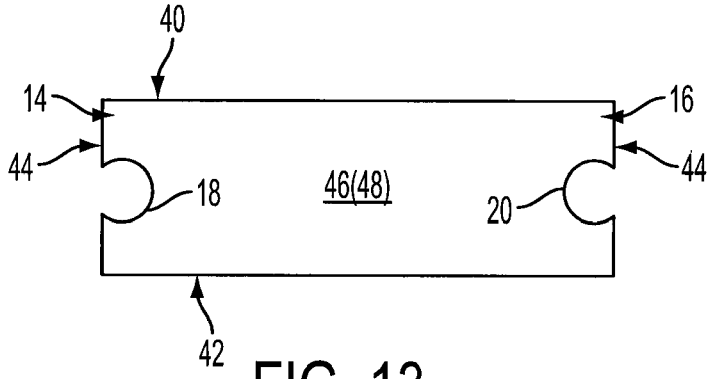
FIGS. 13-17 illustrate side views of needle holders in accordance with other embodiments of the present invention.
Figure 14:
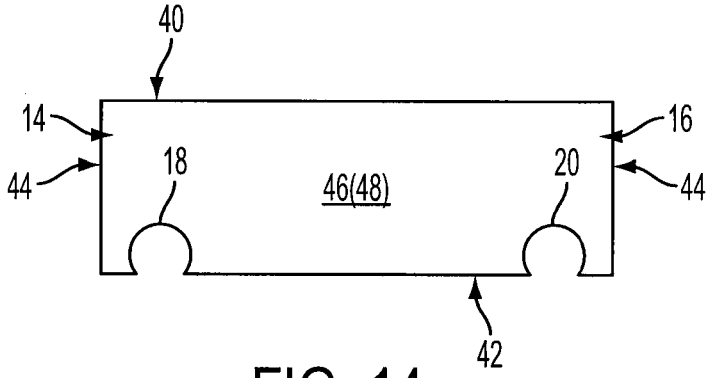

Although apertures 18 and 20 are generally shown as openings provided in side surfaces 44 and extending from front surface 46 to back surface 48 of holder 10 in the embodiments of FIGS. 3-4, it should be understood that the apertures 18 and 20 may be any type of opening or hole sized and/or configured for receiving and holding a knitting needle therein, including, but not limited to: a through hole, a slit, a gap, and the like. For example, FIGS. 7-12 and 15-17 illustrate apertures 18 and 20 as through holes that extend between front surface 46 and back surface 48, through the body 12. Alternate designs and configurations of apertures 18 and 20 for receiving and holding knitting needles are also shown in FIGS. 13 and 14. In the illustrated embodiment of FIG. 13, apertures 18 and 20 are provided in side surfaces 44, extending from front surface 46 to back surface 48, like the illustrated embodiment of FIGS. 1-4, but without receiving areas (further described below). In FIG. 14, apertures 18 and 20 are provided in bottom surface 42, extending from front surface 46 to back surface 48.

Each aperture 18, 20 of the disclosed embodiments, no matter their design or configuration, may have a dimension that corresponds to a size of a knitting needle. In an embodiment, each of the apertures 18 and 20 may be sized such that a knitting needle is friction-fit therein. The size of the apertures and/or insert opening areas may be determined based on a size (e.g., diameter) of a knitting needle to be inserted therein. If an aperture comprises a round or circular opening with a diameter d, for example, the diameter d may be determined based on a size (e.g., diameter) of a knitting needle to be inserted therein, e.g., slightly larger than the diameter or largest part of the knitting needle. When a second (e.g., free) end of a knitting needle is inserted through an aperture 18 or 20, the largest part of the needle would be friction fit in the aperture 18 or 20. Alternatively, in another embodiment, the apertures are formed such that knitting needles are inserted via a snap-fit connection into the corresponding apertures 18, 20 of the end portions 14, 16: Alternatively, in yet another embodiment, the size of the apertures may be slightly smaller than the size (diameter) of the knitting needles, and made from a flexible material that allows for slight expansion during insertion of a needle and a respective holding pressure to be exerted on a needle held therein.

The dimensions of the end portions 14 and 16 and central portion 34 in this disclosure are not meant to be limiting. For example, although in some embodiments the apertures described in this disclosure are noted as having a general diameter d (e.g., see FIGS. 7-12), it should be understood that an aperture need not be a complete circular or round shape. In some embodiments, apertures may be configured to form a snap-fit connection, such as shown in FIGS. 3 and 4. In FIGS. 3-4, each aperture 18 and 20 is of generally of circular or round shape comprising a diameter d, and further comprises an insert opening area comprising a width dimension W2 that is sized to receive a knitting needle and configured to allow a knitting needle to be inserted (e.g., pushed) into its corresponding aperture. The insert opening area that is configured to allow insertion (e.g., sliding, pushing) into a generally circular opening. In an embodiment, the end portions 14 and 16 may be configured to bend or move to allow insertion of the knitting needles into the apertures 18 and 20.

In an embodiment, the insert opening area comprises a width W2 of about 0.338 inches. In an embodiment, a center C of each aperture (e.g., center of the generally circular opening) may be about 0.188 inches from its corresponding end portion. In an embodiment, the apertures 18 and 20 each comprise a diameter of about 0.359 inches.

In an embodiment, main body 12 of holder 10 may comprise an overall length L, an overall width W (or thickness T), and an overall depth D. In an embodiment, for example, the body 12 of holder 10 may comprise an overall length of approximately 3⅜ inches, an overall width (or thickness) of approximately 1 inch, and an overall depth of ½ inch.

Figure 7:
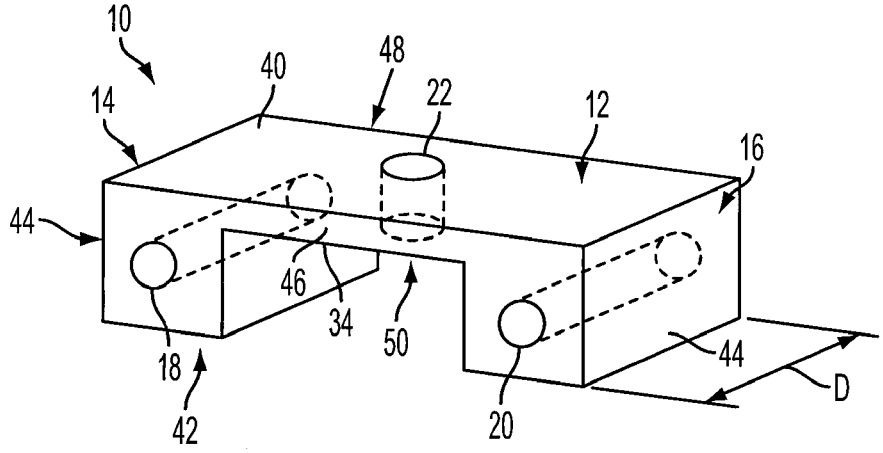
FIGS. 7 and 8 illustrate a perspective view and a side view, respectively, of a needle holder in accordance with another embodiment of the present invention.
Figure 8:
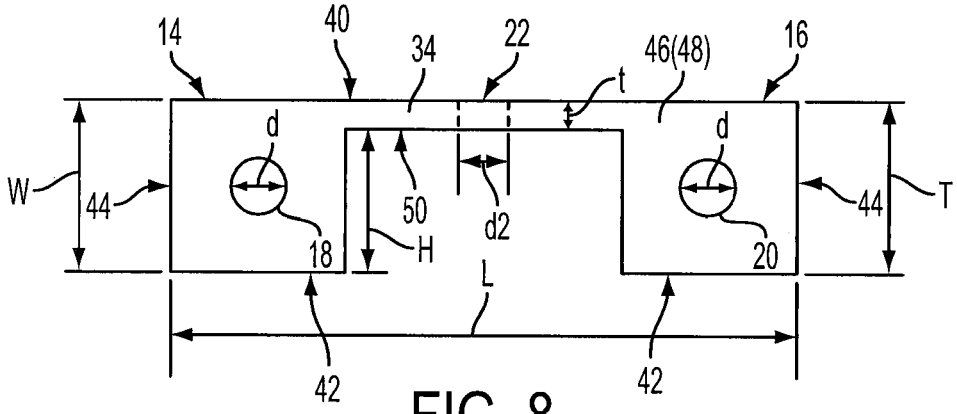
Figure 9:
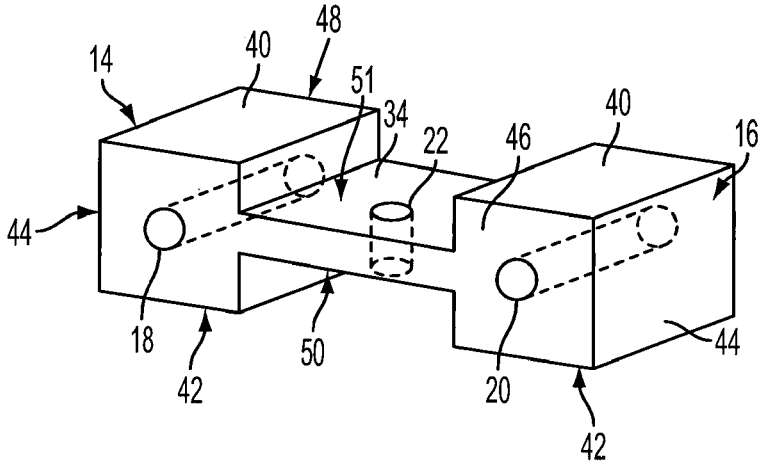
FIGS. 9 and 10 illustrate a perspective view and a side view, respectively, of a needle holder in accordance with another embodiment of the present invention.
Figure 10:
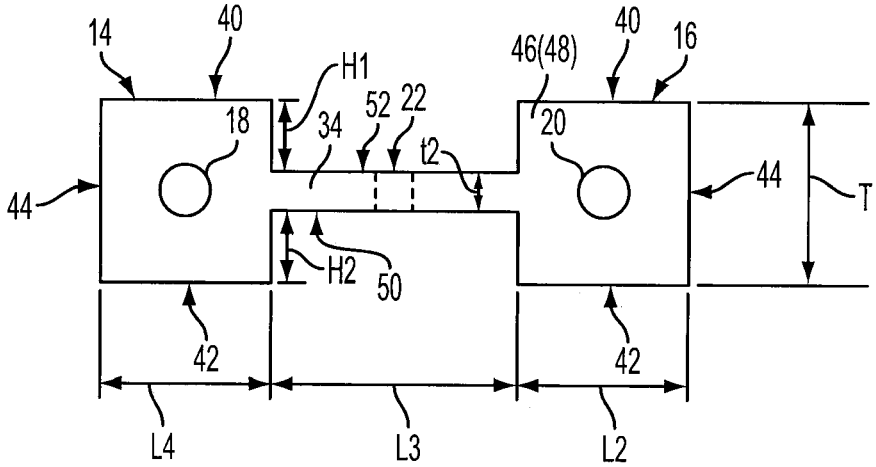

Central portion 34 and end portions 14 and 16 may comprise any number of thicknesses. For example, in an embodiment, a central portion 34 comprises a thickness t that is less than a thickness T of each end portion 14, 16. In the illustrated embodiment of FIGS. 1-4, for example, central portion 34 is positioned and formed relative to a center location or middle of each end portion 14 and 15. An upper surface 51 of central portion 34 is positioned at a height Hi with respect to the top surface 40 of the holder 10 (in this case, each end portion 14 and 16 comprises a top surface 40), and lower or underside surface 50 of central portion 34 is positioned at a height Hi with respect to the bottom surface 42 of the holder 10 (in this case, each end portion 14 and 16 comprises a bottom surface 42). Heights Hi are substantially similar or equal. In another embodiment, such as shown in FIGS. 7 and 8, central portion 34 is positioned and formed as a part of top surface 40 with a thickness t that is less than a thickness of each end portion 14 and 16. A lower or underside surface 50 of central portion 34 is positioned at a height H with respect to the bottom surface 42 of the holder 10. In another embodiment, such as shown in FIGS. 9 and 10, central portion 34 is positioned relative to a center or middle of the end portions 14 and 16 of holder 10. For example, an upper surface 51 of the central portion 34 may be positioned at a height H1 from a top surface 40 of the body 12, and an underside surface 50 may be positioned at a height H2 from the bottom surface(s) 42. In an embodiment, the heights H1 and H2 are substantially similar or equal. In another embodiment, heights H1 and H2 are different. In yet another embodiment, as shown in FIGS. 11 and 12, central portion 34 is flush with the first and second end portions 14 and 16, and comprises a similar or same thickness (T) as end portions 14 and 16.

Central portion 34 and end portions 14 and 16 may also comprise any number of lengths. For example, as shown in FIG. 10, central portion 34 comprises a length L3 and end portions 14 and 16 comprise lengths L4 and L2, respectively. In an embodiment, each length L3, L4, and L2 may be substantially similar or equal to each other in measurement. In another embodiment, the lengths L4 and L2 of end portions 14, 16 is substantially the same. In an embodiment, length L3 of central portion may be larger or smaller than the lengths L4 and L2 of the end portions 14 and 16.

In accordance with an embodiment, end portions 14 and 16 comprise lengths L4 and L2 of about 14/16 of an inch to about 1 inch. In another embodiment, each end portion is approximately 15/16 inches in length. In an embodiment, central portion 34 comprises a length L3 of about 1 and ½ inches.

In an embodiment, holder 10 is manufactured to hold knitting needles of one or more predetermined size. For example, circular knitting needles can commonly be found in a range between and including sizes 3 to 15. Holder(s) 10 in accordance with the herein disclosed embodiments may be formed for each size of circular knitting needles available on the market (currently or in the future). In another embodiment, apertures 18 and 20 may be sized to hold different sized needles. Apertures 18 and 20 may be formed such that different sized needles up to and/or including a specific size needle may be retained therein. For example, apertures 18 and 20 may be configured to hold needles either of size 12 or size 13.

In an embodiment, the main body 12 further comprises a gauge 22. Gauge 22 may be configured and used to measure a size of the knitting needles to be held by the holder 10 (i.e., in apertures 18 and 20), or used to measure a size of the knitting needles being held by the holder (e.g., needles may be taken out of apertures and measured to determine or verify needle size). Gauge 22 comprises a hole or opening for receiving a knitting needle therethrough. Because both the gauge and the holding apertures are sized to accept a needle of a particular size, in an embodiment, gauge 22 comprises a diameter d2 that is substantially similar in size to a size of the diameter of the knitting needles to be held in holder 10. The diameter d2 may be substantially similar in size to width dimension W2, a radius of generally circular opening, or a diameter d of the apertures 18 and 20 for holding knitting needles. In an embodiment, gauge 22 may be slightly larger in diameter d2 than the opening of apertures 18, 20. For example, this may be so that the knitting needles can be inserted and friction fit into apertures 18, 20, and inserted into gauge 22 simply for measurement therein (without friction).

In the illustrated embodiments, gauge 22 is provided in central portion 34. In the illustrated embodiments, of FIGS. 1-4 and FIGS. 9 and 10; gauge 22 extends between upper surface 51 and underside surface 50. In the illustrated embodiment of FIGS. 7 and 8, gauge extends between top surface 40 and underside surface 50. In FIGS. 11 and 12, gauge 22 extends between top surface 40 and a bottom surface 42 of body 12. Gauge 22 may be provided directly in a center of the holder 10, or adjacent front surface 46 or back surface 48.

Figure 5:
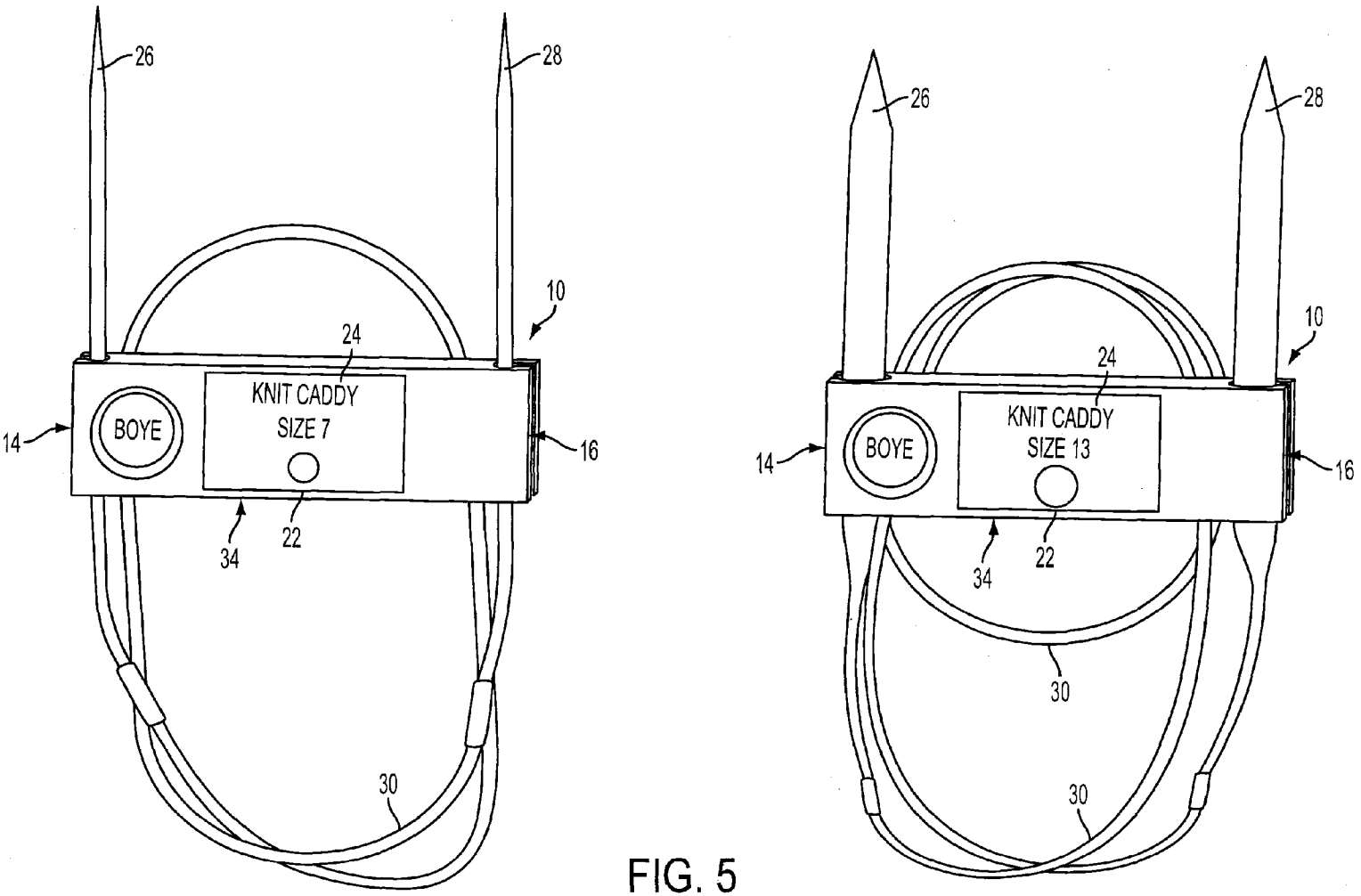
FIGS. 5 and 6 illustrate examples of the needle holder of FIGS. 1-4 in use.
Figure 6:
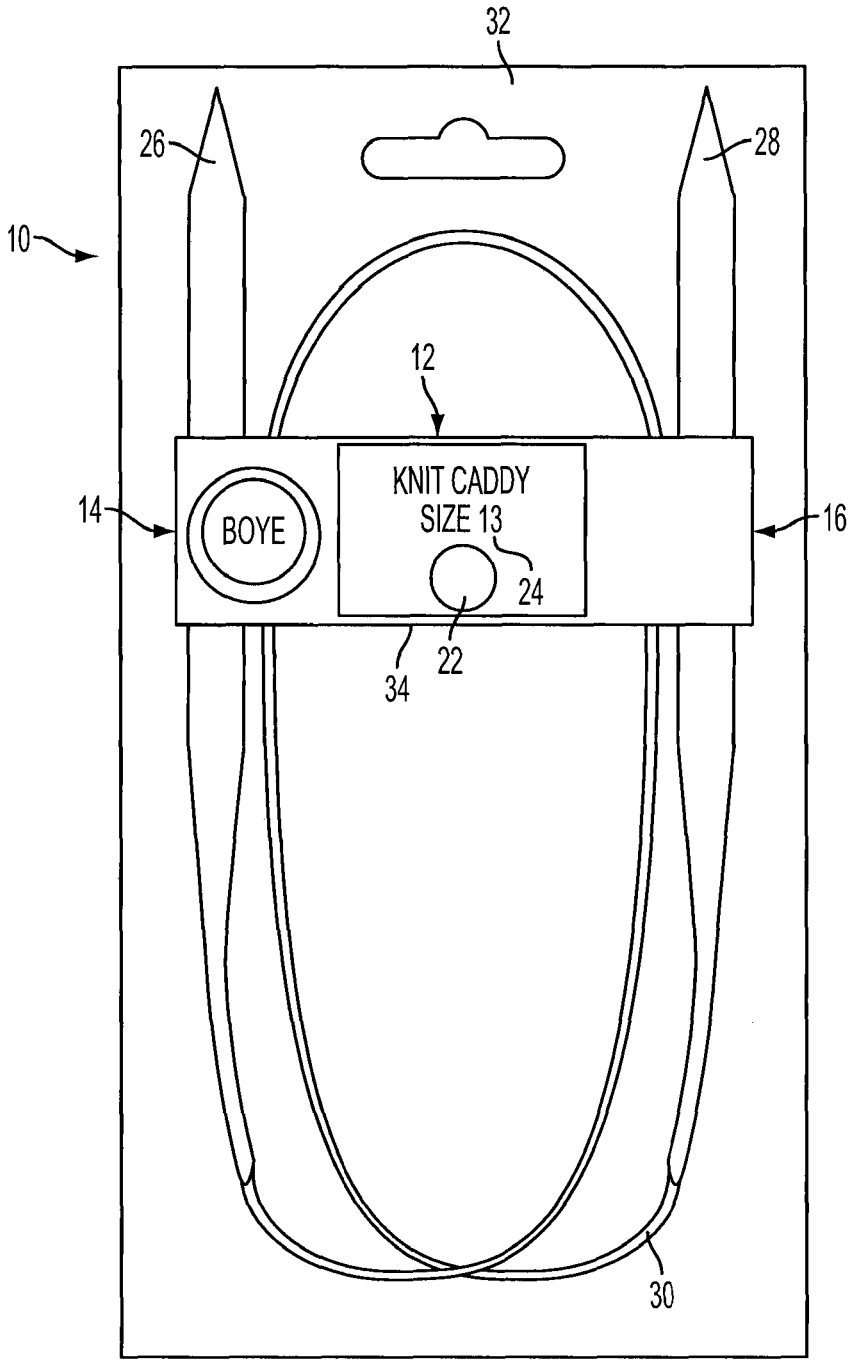

As shown in FIGS. 1, 5, and 6, in an embodiment, the main body 12 may comprise indicia 24 indicating a size of the apertures 18 and 20 for holding knitting needles at each end portion 14 and 16. Thus, a user would be able to easily discern the needle size (and/or largest needle size) which can be held in apertures 18 and 20. Indicia may be provided directly or indirectly on the body 12. In an embodiment, indicia may be provided on a sticker or label that is applied to the main body 12.

In an embodiment, one or more receiving areas 59 may be provided in the portable holder 10. Receiving areas 59 are configured to receive at least part of a flexible cord such as cord 30 when a set of circular knitting needles are held by holder 10. Receiving areas 59 may be holes, openings, slits, gaps, or a similar area sized to receive and temporarily secure a flexible cord therein. In the illustrated embodiment of FIGS. 3 and 4, receiving areas 59 comprise slots in each of the first and second end portions 14 and 16 for receiving at least part of the flexible cord configured to receive the cord therein. Slots 59 are provided adjacent to the corresponding aperture 18 or 20 in each end portion 14 or 16. More specifically, each slot 59 extends from and is accessed through the corresponding aperture in each end portion. Receiving areas 59 may be used when circular knitting needles are inserted into apertures 18 and 20. For example, when circular knitting needles are to be stored in holder 10, the flexible cord may be curved or bent relative to holder 10, and a part of the flexible cord may be inserted (e.g., slid) into receiving areas 59. To use holder 10, needles such as needles 26 and 28 of FIG. 5 may be positioned adjacent apertures 18 and 20 of holder 10. Flexible cord 30 may be flexed, bent, and/or wrapped relative to holder 10 and a portion of the cord 30 is inserted through its relative aperture 18 or 20 and slid into a corresponding slot 59. The needles 26 and 28 are then inserted (e.g., slid or snapped) into apertures 18, 20 of end portions 14, 16.

In an embodiment, the holder 10 and cord 30 are then inserted into caddy 32, such as shown in FIG. 6.

Flexible cord 30 may be curved or wrapped and inserted into slots 59 as many or as little times as necessary. For example, in some instances, cord 30 may be curved or bent at least twice, and inserted through apertures 18 and 20 and into their corresponding slots 59 twice. The length of the flexible cord 30 can determine the number of times cord 30 is wrapped or bent relative to holder 10. Accordingly, holder 10 reduces and/or prevents cord 30 from getting tangled during storage or transportation by separating and securing the cord and needles relative to each other.

Figure 15:
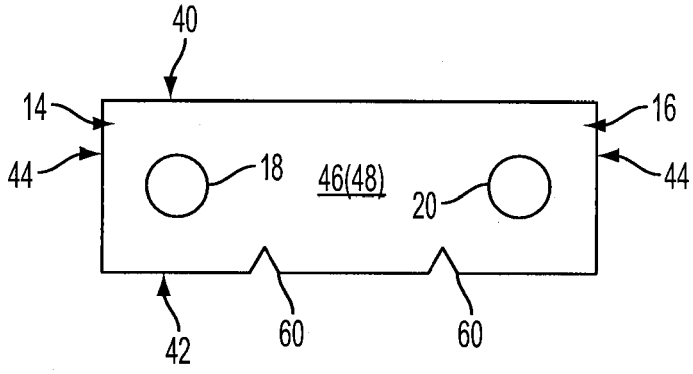

However, the receiving areas may be provided in any location in, on, or through body 12. For example, FIG. 15 illustrates an embodiment wherein the main body 12 comprises one or more alternative receiving areas 60 for receiving at least part of a flexible cord such as cord 30. In FIG. 15, receiving areas 60 are shown on a bottom surface 42 of body 12, and they extend from front surface 46 to back surface 48, but can also be provided in any location in, on, or through body 12. Receiving areas 60 may be used when needles are inserted into apertures 18 and 20. For example, when circular knitting needles are stored in holder 10, the flexible cord may be curved or bent and a part of the flexible cord may be inserted (e.g., snapped) into receiving areas 60. For example, a part of the flexible cord 30 may be positioned underneath the holder 10 and inserted into receiving areas 60 to secure the cord 30 to the holder 10. In embodiment, receiving areas 60 may also be used in combination with receiving slots 59. For example, depending on the length of the cord, part of the cord may be inserted through apertures 18 and 20 and into slots 59, and any remaining cord may be turned, curved, or bent and held by receiving areas 60.

In accordance with yet another embodiment, holder 10 may further comprise additional openings or apertures. In an embodiment, the first and second end portions 14 and 16 may each further comprise a respective second aperture. Additionally or alternatively, one or more apertures may be provided in central portion 34. The additional or second apertures may be used as receiving areas for receiving a part of a flexible cord or a second set of knitting needles (and/or a single needle).

Figure 16:
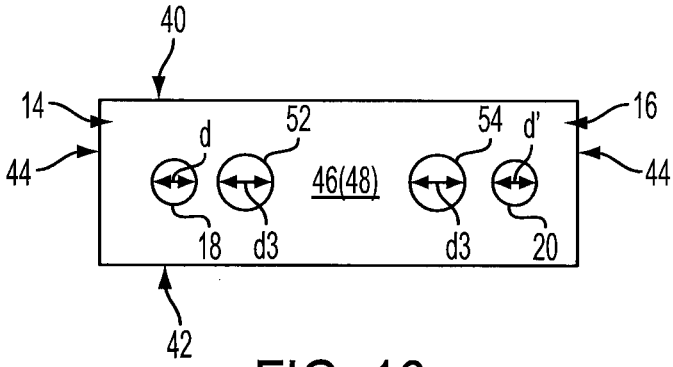

FIG. 16 illustrates an embodiment wherein second apertures 52 and 54 are provided in end portions 14 and 16, respectively, adjacent apertures 18 and 20. Apertures 52 and 54 may be receiving areas, and may be used to hold and receive a flexible cord when circular knitting needles are held in holder 10. Apertures 52 and 54 are sized such that needles to be held by apertures 18 and 20 may be inserted into and therethrough. For example, a needle 26 may be first inserted through aperture 54 and then inserted into aperture 18 (and retained therein). Needle 28 may be first inserted through aperture 52 and then inserted into aperture 20 (and retained therein). By sizing the apertures 52 and 54 slightly larger than the apertures 18 and 20, needles 26 and 28 and their cord 30 may be fed easily therethrough. In an embodiment, aperture 52 and 54 may comprise a diameter d3 that is at least slightly larger than the diameter d of apertures 18 and 20. Diameter d3 of apertures 52 and 54 may be determined based on diameter d of apertures 18 and 20.

Figure 17:
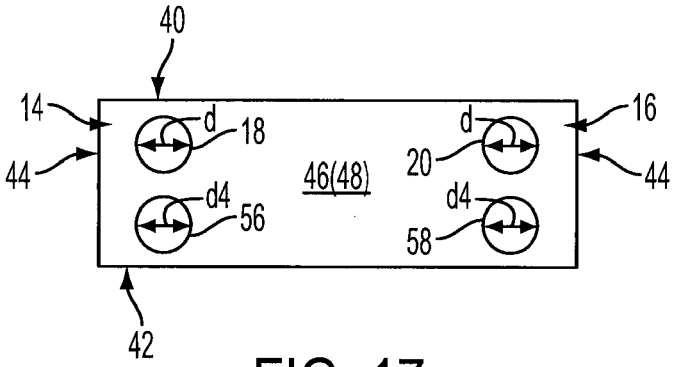

FIG. 17 illustrates an example of another embodiment with a second set of apertures 56 and 58. In this embodiment, the two sets of apertures in holder 10 are configured to hold more than one set of knitting needles, e.g., three or more needles or two sets of knitting needles. As shown, the first and second end portions 14 and 16 may each further comprise a respective second aperture 56 and 58. The first and second corresponding apertures (18 and 56 in end portion 14, and 20 and 58 in end portion 16) are sized to hold a first pair of knitting needles and a second pair of knitting needles, respectively. In an embodiment, the apertures 18, and 56, 58 are sized to receive and hold knitting needles of the same size (e.g., size 13). In another embodiment, apertures 18, 20 are sized to hold knitting needles of a first size (e.g., size 12), and apertures 56, 58 are sized to hold knitting of a second size (e.g., size 13).

To use a holder 10 without receiving areas 59 or 60, such as shown in FIGS. 7-12, the needles can be inserted (e.g., slid or snapped) into apertures 18, 20 of end portions 14, 16. Flexible cord 30 may be flexed, bent, and/or wrapped relative to holder 10 (e.g., around central portion 34, under central portion 34, etc.). Accordingly, holder 10 reduces and/or prevents cord 30 from getting tangled by separating and securing needles relative to each other, even though flexible cord 30 is not directly attached in main body 12 of holder 10.

The dimensions and/or size of portable holder 10 and its features should not be limited to those disclosed above. The features of holder 10—including, but not limited to, diameter d of apertures 18 and 20, thickness t of central portion 34, and heights Hi, H, H1, and H2 and lengths L2, L3, and L4 related to central and end portions 34, 14, and 16, respectively—should also not be limited. Although a dimension may be illustrated in one FIG., it should be understood that said dimensions may apply to none, any or all of the other holders illustrated in the FIGS., and that such markings were shown merely for clarity purposes only.

The type(s) of materials and/or method(s) used to manufacture portable holder 10 should not be limited. As an example, holder 10 may be made out of one or more molded plastic materials. Alternatively, in another embodiment, holder 10 may be made out of formed or molded elastic or rubber material(s). In another embodiment, two or more materials may be used to manufacture holder 10.

The types and sizes of knitting needles held by the holder 10 should not be limited. For example, as previously noted, either or both straight and circular knitting needles may be held by holder 10. Also, holder 10 can hold circular knitting needles with a cord of any number of lengths (e.g., 11, 16, 24, 29, 34, 36 or 40 inch length cord).

Moreover, it is also envisioned that it is within the scope of this disclosure that, in an embodiment, the cord (e.g., cord 30) of a set of circular knitting needles (e.g., needles 26, 28) need not be permanently fixed to the knitting needles when held and/or transported by portable holder 10 and/or caddy 32. For example, although some circular knitting needles are permanently or semi-permanently fixed at their first ends to a cord, there are also interchangeable systems for exchanging a cord (e.g., to one of a different length) and/or for different sized needles. When the needles are stored in holder 10, the cord can remain attached to the first ends of the needles, or be temporarily removed therefrom (and held in caddy 32, for example).

It should also be understood that, while not shown in the drawings, knitting needles may have yarn or materials for a project that associated therewith when using holder 10.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A holder for holding a set of knitting needles comprising:

a main body having first and second end portions;

each end portion having a corresponding aperture, each aperture sized to hold one knitting needle of the set of knitting needles such that the needles are relatively parallel to each other when inserted into the apertures of the holder, wherein the main body further comprises a gauge configured to measure a size of a knitting needle, the gauge and apertures each sized to accept a needle of a same size, and wherein the gauge is positioned perpendicularly to the apertures of the holder.

2. The holder according to claim 1, wherein the main body comprises indicia indicating a size of the apertures for holding knitting needles at each end portion.

3. The holder according to claim 1, wherein the holder is configured to hold straight needles, the corresponding apertures in the first and second end portions of the main body being sized to hold the straight knitting needles.

4. The holder according to claim 1, wherein the holder is configured to hold circular knitting needles, each needle having a first end and a second end, the first ends being connected by a flexible cord; and wherein the corresponding apertures in the first and second end portions of the main body are sized to hold the circular knitting needles.

5. The holder according to claim 4, wherein the main body further comprises a receiving area for receiving at least part of the flexible cord.

6. The holder according to claim 4, wherein the main body further comprises a receiving area in each of the first and second end portions for receiving at least part of the flexible cord.

7. The holder according to claim 5, wherein each receiving area comprises a slot.

8. The holder according to claim 7, wherein each slot is provided adjacent to the corresponding aperture in each end portion.

9. The holder according to claim 7, wherein each slot extends from and is accessed through the corresponding aperture in each end portion.

10. The holder according to claim 1, wherein the main body further comprises a central portion connecting the first and second end portions.

11. The holder according to claim 10, wherein the central portion comprises a thickness less than a thickness of each end portion.

12. The holder according to claim 10, wherein the central portion is flush with the first and second end portions.

13. The holder according to claim 1, wherein the holder is configured to receive each knitting needle in the corresponding apertures of the end portions via a snap-fit connection.

14. The holder according to claim 1, wherein the first and second end portions each further comprise a second aperture, and wherein the corresponding apertures and second apertures are sized to hold a first pair of knitting needles and a second pair of knitting needles, respectively.

15. The holder according to claim 1, wherein the apertures are through holes.

16. The holder according to claim 1, wherein the apertures comprise a width or a diameter based on the size of a knitting needle to be inserted therein, and wherein the gauge comprises a substantially similar width or diameter.

* * * * *